US007623104B2

(12) United States Patent
Lin

(10) Patent No.: US 7,623,104 B2
(45) Date of Patent: Nov. 24, 2009

(54) DISPLAY AND DISPLAY CONTROL METHOD

(75) Inventor: Feng-Li Lin, Taipei County (TW)

(73) Assignee: Gigno Technology Co., Ltd., Taipei (TW)

( * ) Notice: Subject to any disclaimer, the term of this patent is extended or adjusted under 35 U.S.C. 154(b) by 617 days.

(21) Appl. No.: 11/412,169

(22) Filed: Apr. 27, 2006

(65) Prior Publication Data

US 2006/0267920 A1 Nov. 30, 2006

(30) Foreign Application Priority Data

May 25, 2005 (TW) ..... 94117129 A

(51) Int. Cl.
*G09G 3/36* (2006.01)

(52) U.S. Cl. ..... 345/87; 345/102

(58) Field of Classification Search ..... 345/87, 345/102

See application file for complete search history.

(56) References Cited

U.S. PATENT DOCUMENTS 5,786,801 A * 7/1998 Ichise ..... 345/102
2002/0030660 A1* 3/2002 Arakawa ..... 345/102
2002/0047818 A1* 4/2002 Yamamoto et al. ..... 345/87
2002/0057238 A1* 5/2002 Nitta et al. ..... 345/87
2003/0001983 A1* 1/2003 Nose ..... 349/61
2005/0062681 A1* 3/2005 Honbo ..... 345/10
2006/0152469 A1* 7/2006 Hsu ..... 345/102

* cited by examiner

*Primary Examiner*—Amare Mengistu
*Assistant Examiner*—Koosha Sharifi
(74) *Attorney, Agent, or Firm*—Birch, Stewart, Kolasch & Birch, LLP

(57) ABSTRACT

A display control method inputs a plurality of frames into a display, which records a sequential flashing threshold value. Each of the frames has a plurality of pixels. The display control method includes a frames-comparing procedure, a play-mode determining procedure, and a sequential flashing controlling procedure. The frames-comparing procedure generates a motion activity value by way of comparing pixels between two of the frames. The play-mode determining procedure determines whether the two frames are in a relationship of a motion mode or not according to the motion activity value and the flashing threshold value, and therefore generates a sequential flashing controlling signal. The sequential flashing controlling procedure performs a sequential flashing process according to the sequential flashing controlling signal.

26 Claims, 5 Drawing Sheets

DISPLAY AND DISPLAY CONTROL METHOD

BACKGROUND OF THE INVENTION

1. Field of Invention

The invention relates to a display and a display control method and, in particular, to a display device and a display control method that can dynamically perform a sequential flash control process.

2. Related Art

Recently, the liquid crystal display devices are widely used in many application fields. For example, the liquid crystal display device can be used as a monitor of a computer, a touch control panel for the human-machine interface (HMI), or a television for cooperating with the video system. Although it can be used in many application fields, there are some technical problems to be solved, such as the view angle problem, the contrast problem, the color saturation problem, and the response time problem.

Accompanying the development of the technology, most of the above-mentioned problems are well treated, but it still needs more efforts to solve the response time problem. The goal for solving the response time problem is to make the liquid crystal display device having the animation display effect as a CRT (cathode-ray tube) displayer. The reason why the conventional liquid crystal display device can not achieve the desired animation display effect is that, excepting the limitation of response time, the conventional liquid crystal display device renders the hold-type display method, which is different from the impulse-type display method used in the CRT displayer.

As mentioned above, regarding to the impulse-type display method, the human eyes may not have the blurring phenomenon when tracking the motion object on the screen. Alternatively, regarding to the hold-type display method, the human eyes may have the blurring phenomenon when tracking the motion object on the screen.

Recently, the manufacturer discloses a blinking technology for solving the blurring phenomenon. The blinking technology is to repeatedly turn on and turn off the light-emitting units of the backlighting, so that the backlighting of the liquid crystal display device can imitate the impulse-type display method so as to eliminate the blurring phenomenon. However, since the light-emitting units are turned on/off repeatedly, the luminance of the display screen may change by a wide margin, which leads to the flicker phenomenon in vision.

In addition, the manufacturer also discloses a sequential flashing technology for solving the blurring phenomenon. The sequential flashing technology is to light on and turn off the light-emitting units during a frame time in sequence, so that the light-emitting units can flash in turn to imitate the impulse-type display method for improving the blurring phenomenon of the motion image. However, when the screen displays the motionless image, and the light-emitting units still flash, the motionless image may have the flicker phenomenon in vision.

Therefore, it is an important subject of the invention to provide a display and a display control method thereof for improving the blurring phenomenon and preventing the flicker phenomenon.

SUMMARY OF THE INVENTION

In view of the foregoing, the invention is to provide a display and a display control method, which can improve the blurring phenomenon and prevent the flicker phenomenon.

To achieve the above, a display control method of the invention is used to input a plurality of frames into a display, which records a sequential flashing threshold value. Each of the frames has a plurality of pixels. The display control method includes a frames-comparing procedure, a play-mode determining procedure, and a sequential flashing controlling procedure. The frames-comparing procedure generates a motion activity value by way of comparing pixels between two of the frames. The play-mode determining procedure determines whether the two frames are in a relationship of a motion mode or not according to the motion activity value and the flashing threshold value, and therefore generates a sequential flashing controlling signal. The sequential flashing controlling procedure performs a sequential flashing process according to the sequential flashing controlling signal.

To achieve the above, the invention also discloses a display for displaying a plurality of frames in sequence. Each of the frames has a plurality of pixels and the display has a preset module for recording a sequential flashing threshold value. The display includes a frames-comparing module, a play-mode determining module and a sequential flashing controlling module. The frames-comparing module compares the pixels between at least two of the frames so as to generate a motion activity value. The play-mode determining module determines whether the two frames are in a relationship of a motion mode or not according to the motion activity value and the sequential flashing threshold value. If so, the play-mode determining module then generates a sequential flashing controlling signal. The sequential flashing controlling module performs a sequential flashing process according to the sequential flashing controlling signal.

As mentioned above, the display and the display control method of the invention are to obtain the motion activity value by comparing the pixels between two frames, and then determine the relationship between the frames is a motion mode or a motionless mode by comparing the motion activity value and the sequential flashing threshold value. Then, the invention can decide whether to perform a sequential flashing process for improving the blurring phenomenon and preventing the flicker phenomenon.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

It should be known that the common display method is to continuously display a plurality of frames to show the moving image.

Figure 1:
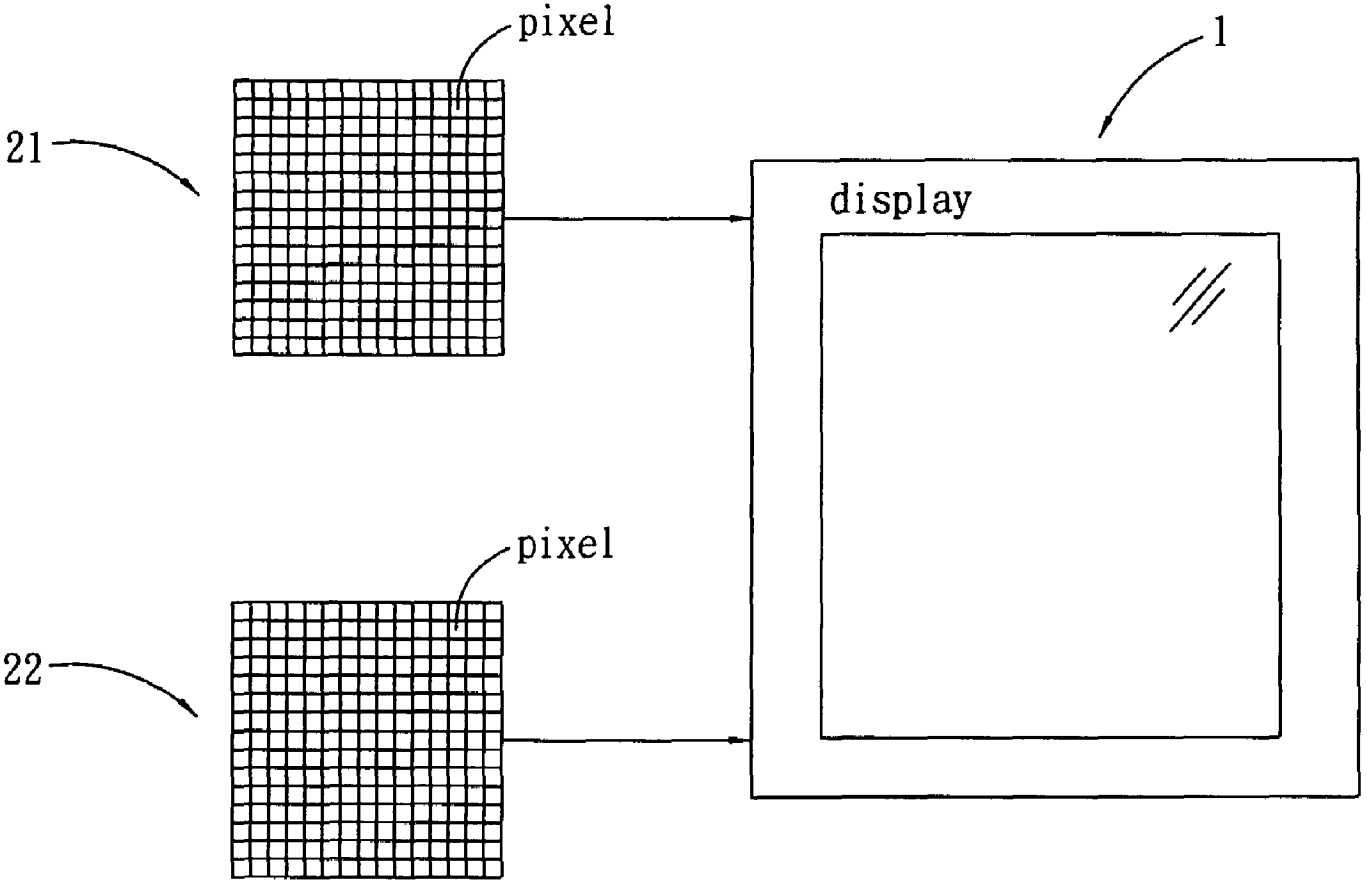
FIG. 1 is a schematic diagram showing frames inputted into a display according to a preferred embodiment of the invention.

As shown in FIG. 1, in a preferred embodiment of the invention, a first frame 21 and a second frame 22 are inputted into a display 1 in sequence. Each frame includes a plurality of pixels. In the embodiment, the first frame 21 and the second frame 22 may be or may be not two sequentially inputted frames. In addition, the display 1 may have a backlight composed of, for example, cold cathode fluorescent lamps (CCFL) or light-emitting diodes (LED).

Figure 2:
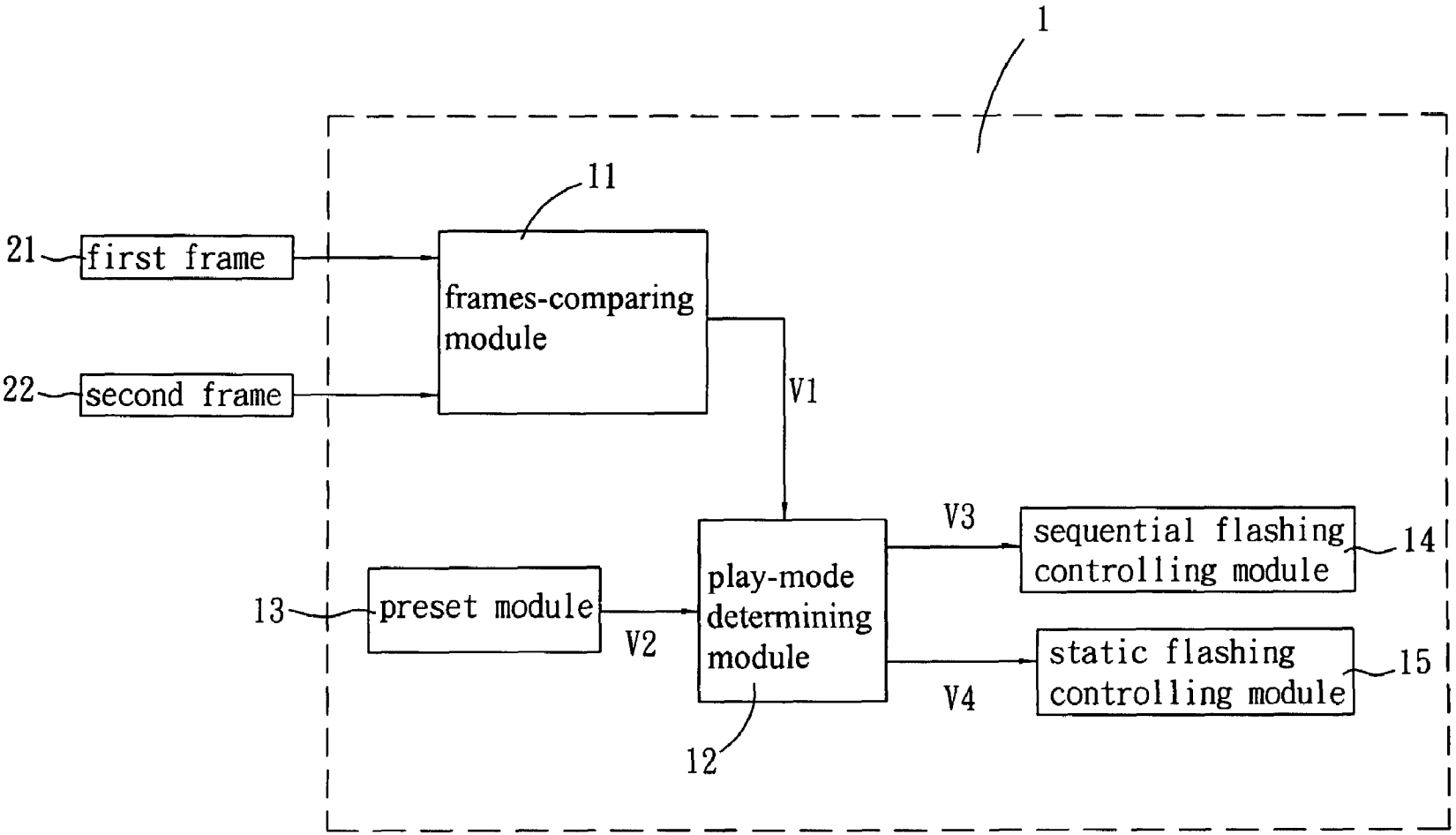
FIG. 2 is a schematic diagram showing a display according to a preferred embodiment of the invention.

With reference to FIG. 2, the display 1 according to the preferred embodiment of the invention includes a frames-comparing module 11, a play-mode determining module 12, a preset module 13, a sequential flashing controlling module 14, and a static flashing controlling module 15. In this embodiment, the preset module 13 records a sequential flashing threshold value V2.

The frames-comparing module 11 compares the pixels between the first frame 21 and the second frame 22 so as to generate a motion activity value V1. In the embodiment, the motion activity value V1 represents the motion composition of the image.

The play-mode determining module 12 determines that the continuous first and second frames 21 and 22 are in a relationship of a motion mode or a motionless mode according to the motion activity value V1 and the sequential flashing threshold value V2 recorded in the preset module 13.

In the present embodiment, when the play-mode determining module 12 determines that the continuous first and second frames 21 and 22 are in a relationship of a motion mode according to the motion activity value V1 and the sequential flashing threshold value V2, it will generate a sequential flashing controlling signal V3, which is then transmitted to the sequential flashing controlling module 14. Accordingly, the sequential flashing controlling module 14 performs a sequential flashing process with respect to the backlight of the display 1. In this case, the backlight module of the display 1, for example, is composed of six CCFLs. Thus, the sequential flashing process is to light on and turn off each of the six CCFLs in sequence, or to light on and turn off every two of the six CCFLs in sequence. As a result, the blurring phenomenon of the motion image can be improved.

Alternatively, when the play-mode determining module 12 determines that the continuous first and second frames 21 and 22 are in a relationship of a motionless mode according to the motion activity value V1 and the sequential flashing threshold value V2, it will generate a static flashing controlling signal V4, which is then transmitted to the static flashing controlling module 15. Accordingly, the static flashing controlling module 15 performs a static flashing process with respect to the backlight of the display 1. In this case, the static flashing process is to control the backlight of the display 1 to stop performing the sequential flashing process. In other words, during the static flashing process, the backlight is controlled similar to the prior art, which does not performing sequential flashing process.

Figure 3:
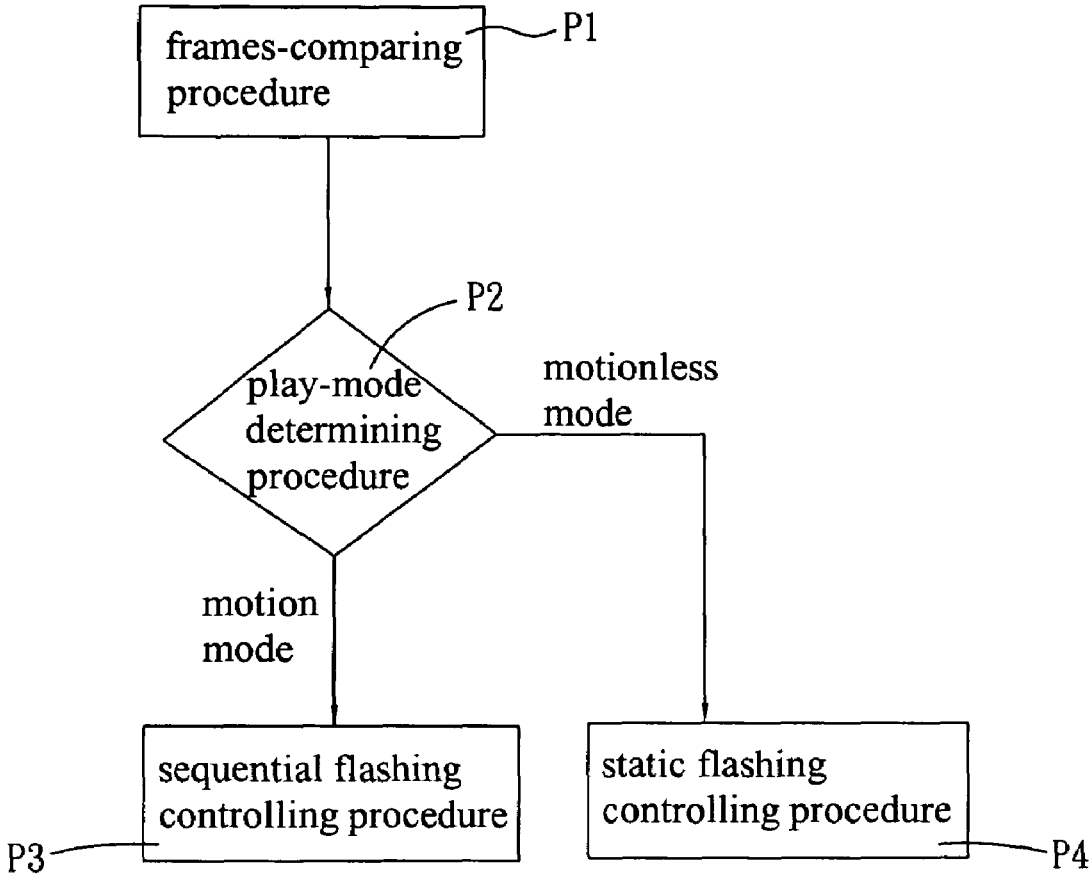
FIG. 3 is a flow chart showing a display control method according to a preferred embodiment of the invention.

With reference to FIG. 3 in view of the above descriptions, a display control method according to the embodiment of the invention will be described hereinafter. The display control method includes a frames-comparing procedure P1, a play-mode determining procedure P2, a sequential flashing controlling procedure P3, and a static flashing controlling procedure P4.

The frames-comparing procedure P1 is to compare the pixels between at least two of the frames so as to generate a motion activity value V1, which represents the motion composition of the image. In this embodiment, the first frame 21 and the second frame 22 are inputted into the display 1 in sequence. In more detailed, the first frame 21 is inputted into the display 1 at the timing T, and the second frame 22 is inputted into the display 1 at the timing T+1.

Each of the first frame 21 and the second frame 22 contains a plurality of pixels, and each of the pixels is composed of primary colors of RGB or other color system such as the YUV color system. Each pixel may include 24 bits, and each color (Red, Green, or Blue) is represented by 8 bits, which means 0 to 255.

In the embodiment, the procedure P1 can calculate the color value of the first frame 21 according to all pixels of the first frame 21, ad calculate the color value of the second frame 22 according to all pixels of the second frame 22. Then, according to the color values of the first frame 21 and the second frame 22, the motion activity value V1, which represents the motion composition of the image between the first frame 21 and the second frame 22, can be obtained.

Figure 4:
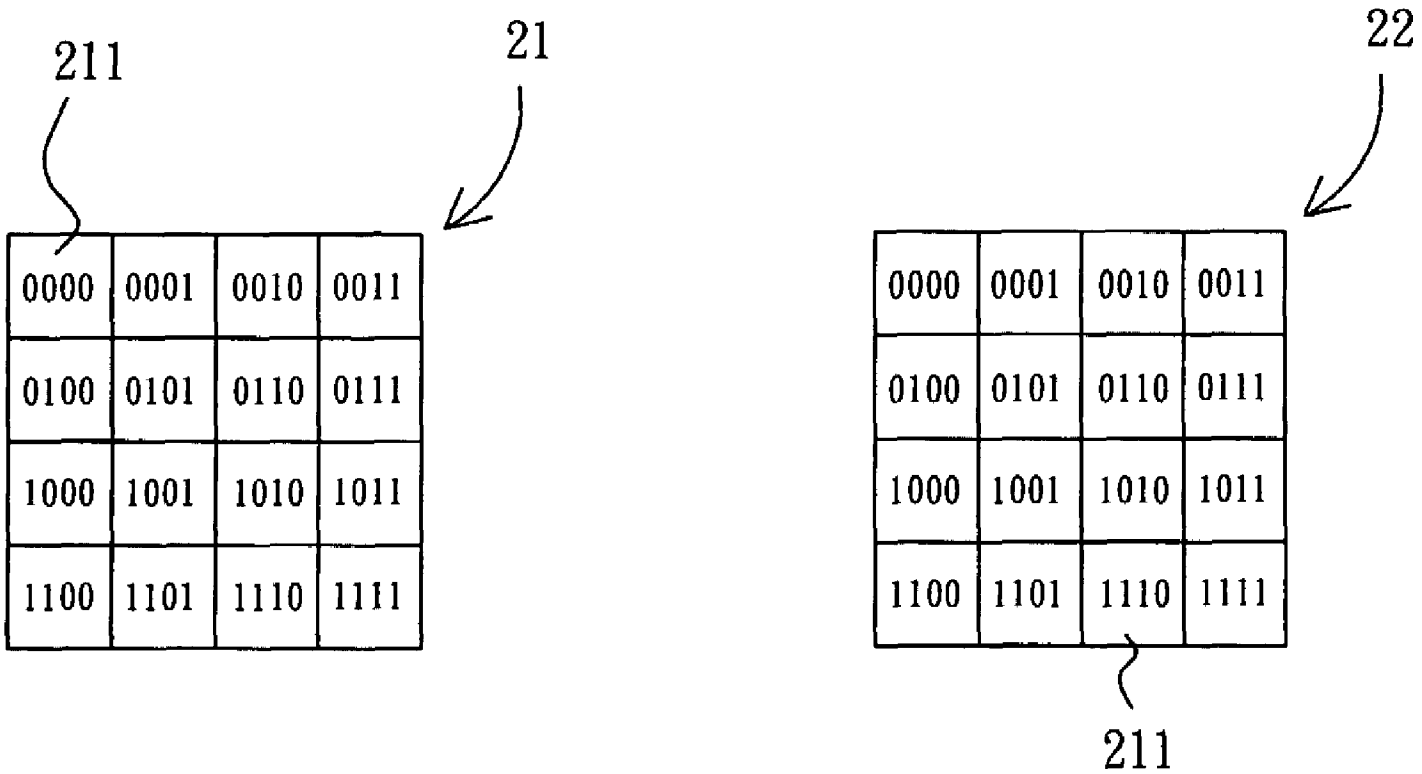
FIG. 4 is a schematic diagram showing a first frame and a second frame of the display control method according to the embodiment of the invention.

With reference to FIG. 4, the procedure P1 of this embodiment may divide the first frame 21 into 16 areas, and each area is represented by 4 bits, such as "0000", "0001", "0010", etc. Similarly, the procedure P1 may also divide the second frame 22 into 16 areas, and select a first area 211, such as "1110", of the second frame 22. Then, the selected first area 211 is compared with all pixels of each area in the first frame 21 so as to find out one area of the first frame 21 that is most similar to the first area 211 of the second fame 22. By this way, the procedure P1 can determine that the first area 211 moves to the corresponding one of the 16 areas in the first frame 21, and thus calculate the moving value of the first area 211. In the present embodiment, the first area 211 of the second frame 22 is corresponding to the area of "0000" in the first frame 21. That is, the area of "0000" in the first frame 21 has the color value similar to the area of "1110" in the second frame 22. After that, the procedure P1 compares the residual areas between the second frame 22 and the first frame 21 so as to obtain the moving value of each area in the second frame 22. Then, the moving values are averaged to calculate the motion activity value V1 for representing the motion composition between the first frame 21 and the second frame 22. Of course, if the frames are divided into more areas, the comparing result may be more precise.

To be noted, the calculating method for obtaining the above-mentioned result of moving values is not limited to the previously described method. For example, the optical flow technique may also be used to calculate the moving values of the display screen.

With reference to FIG. 3 again, the play-mode determining procedure P2 is performed after the frames-comparing procedure P1. The play-mode determining procedure P2 is to use the play-mode determining module 12 to determine that the first frame 21 and the second frame 22 are in a relationship of a motion mode or a motionless mode according to the motion activity value V1 and the sequential flashing threshold value V2 recorded in the preset module 13. In the embodiment, if the motion activity value V1 is greater than the sequential flashing threshold value V2, the relationship between the first frame 21 and the second frame 22 is in the motion mode. Otherwise, if the motion activity value V1 is less than the sequential flashing threshold value V2, the relationship between the first frame 21 and the second frame 22 is in the motionless mode.

Figure 5:
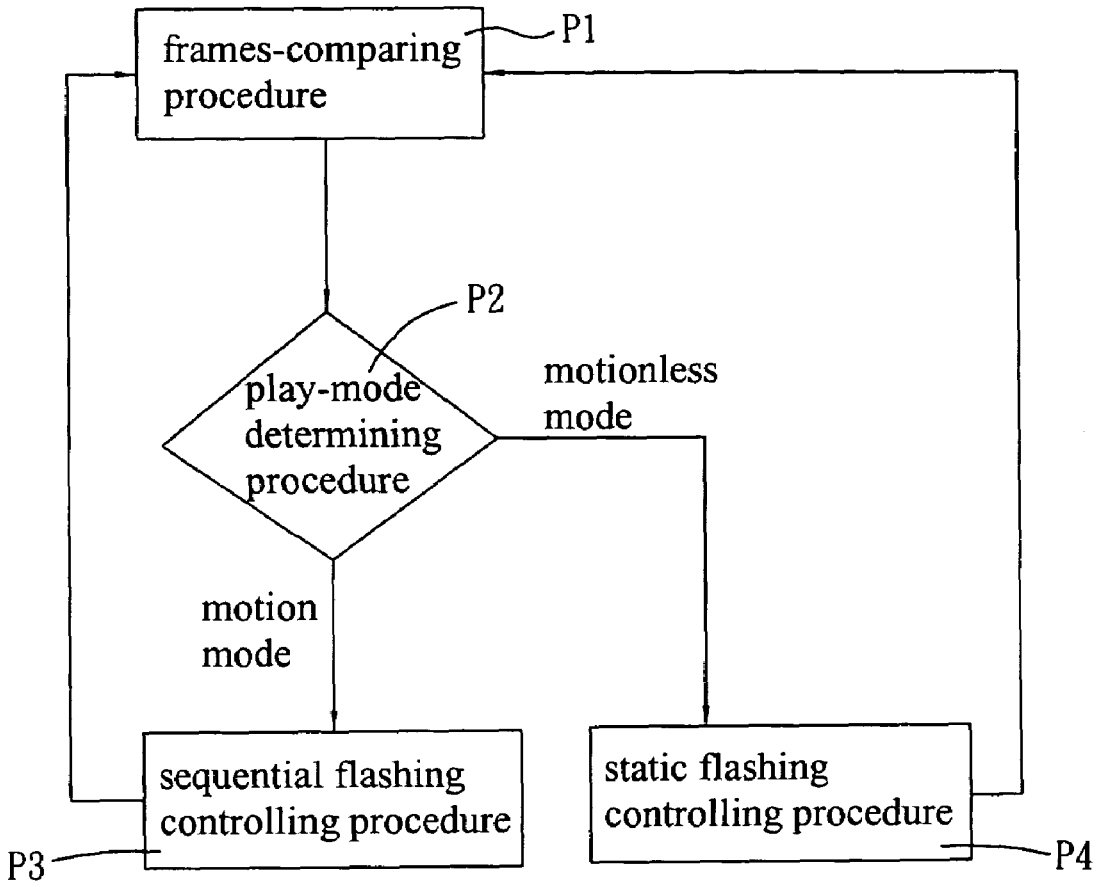
FIG. 5 is a flow chart showing another display control method according to a preferred embodiment of the invention.

In the embodiment, when the play-mode determining module 12 determines that the first frame 21 and the second frame 22 are in a relationship of a motion mode according to the motion activity value V1 and the sequential flashing threshold value V2, it will generate a sequential flashing controlling signal V3. Then, the sequential flashing controlling procedure P3 is performed. In the sequential flashing controlling procedure P3, the play-mode determining module 12 transmits the sequential flashing controlling signal V3 to the sequential flashing controlling module 14, so that the sequential flashing controlling module 14 can perform a sequential flashing process with respect to the backlight module of the display 1. In this case, the backlight module of the display 1, for example, is composed of six CCFLs. Thus, the sequential flashing process is to light on and turn off each of the six CCFLs in sequence, or to light on and turn off every two of the six CCFLs in sequence. As a result, the blurring phenomenon of the motion image can be improved. After the sequential flashing controlling procedure P3, the frames-comparing procedure P1 for next set of frames is continuously performed (as shown in FIG. 5).

In addition, when the play-mode determining module 12 determines that the first frame 21 and the second frame 22 are in a relationship of a motionless mode according to the motion activity value V1 and the sequential flashing threshold value V2, it will generate a static flashing controlling signal V4. Then, the static flashing controlling procedure P4 is performed. In the static flashing controlling procedure P4, the play-mode determining module 12 transmits the static flashing controlling signal V4 to the static flashing controlling module 15, so that the static flashing controlling module 15 can perform a static flashing process with respect to the backlight module of the display 1. After the static flashing controlling procedure P4, the frames-comparing procedure P1 for next set of frames is continuously performed (as shown in FIG. 5).

In brief, when the display 1 plays the motion image, which easily causes the blurring phenomenon, the sequential flashing process is performed to improve the blurring phenomenon. In addition, when the display 1 plays the static image, the static flashing process, which controls the light-emitting units of the backlight module in the display 1 to be always lighted on without flashing, is performed. Thus, the user would not feel the flicker phenomenon.

Certainly, not all motion images make the user feel the blurring phenomenon. Therefore, the sequential flashing threshold value V2 recorded in the preset module 13 may be automatically adjusted by the display 1 or manually adjusted by a user. Accordingly, the invention can decide a part of the motion images, which make the user feel the blurring phenomenon, for performing the sequential flashing process, so that the blurring phenomenon can be improved efficiently.

In addition, since the flicker phenomenon is various depending on the luminance, which makes the user having different feelings, the invention allows the sequential flashing threshold value V2 to be modulated depending on a luminance. In the embodiment, the luminance may be a luminance of the display or an environmental luminance. In general, when the luminance of the display is bright or the environmental luminance is dark, the user becomes sensitive about the flicker phenomenon. Thus, these conditions are unsuitable for performing the sequential flashing process. As a result, the sequential flashing threshold value V2 should be modulated higher when the luminance of the display is brighter, and the sequential flashing threshold value V2 should be modulated lower when the environmental luminance is brighter. In brief, the luminance of the display is directly proportional to the sequential flashing threshold value V2, and the environmental luminance is inversely proportional to the sequential flashing threshold value V2.

In summary, the display and the display control method of the invention break the conventional thought of always performing the sequential flashing process or never performing the sequential flashing process in one display device. The display and the display control method of the invention are to compare the pixels between the frames so as to determine whether the motion activity value is greater than the sequential flashing threshold value or not for judging that the play mode of the display is a motion mode or a motionless mode. Accordingly, the invention can decide whether to perform the sequential flashing process. If the display plays the motionless image, the sequential flashing process will not be performed so that the flicker phenomenon can be prevented. In addition, if the display plays the motion image, the sequential flashing process will be performed so that the blurring phenomenon can be improved. Moreover, the invention further considers the luminance factor, so that the invention can efficiently improve the blurring phenomenon and prevent the flicker phenomenon of the display.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A display control method for inputting a plurality of frames into a display, wherein each of the frames has a plurality of pixels and the display has a preset module for recording a sequential flashing threshold value, the method comprising:

a frames-comparing procedure for comparing the pixels between at least two of the frames to obtain corresponding moving values, wherein the corresponding moving values are averaged to generate a motion activity value;

a play-mode determining procedure for determining whether the two frames are in a relationship of a motion mode or not according to the motion activity value and the sequential flashing threshold value, and therefore generating a sequential flashing controlling signal; and a sequential flashing controlling procedure for performing a sequential flashing process according to the sequential flashing controlling signal, wherein the motion activity value is greater than the sequential flashing threshold value in the motion mode.

2. The method of claim 1, wherein the frames-comparing procedure is performed again after the sequential flashing controlling procedure.

3. The method of claim 1, wherein the play-mode determining procedure further determines whether the two frames are in a relationship of a motionless mode or not according to the motion activity value and the sequential flashing threshold value, and therefore generates a static flashing controlling signal.

4. The method of claim 3, further comprising:

a static flashing controlling procedure for performing a static flashing process according to the static flashing controlling signal.

5. The method of claim 4, wherein the frames-comparing procedure is performed again after the static flashing controlling procedure.

6. The method of claim 3, wherein the motion activity value is less than the sequential flashing threshold value in the motionless mode.

7. The method of claim 1, wherein the two frames are sequentially inputted frames.

8. The method of claim 1, wherein the sequential flashing threshold value is modulated depending on a luminance.

9. The method of claim 8, wherein the luminance is a luminance of the display.

10. The method of claim 9, wherein the luminance of the display is directly proportional to the sequential flashing threshold value.

11. The method of claim 8, wherein the luminance is an environmental luminance.

12. The method of claim 11, wherein the environmental luminance is inversely proportional to the sequential flashing threshold value.

13. The method of claim 1, wherein the sequential flashing process is to light on and turn off light-emitting units of a backlight module of the display in sequence.

14. The method of claim 1, wherein the sequential flashing threshold value is automatically adjusted by the display or manually adjusted by a user.

15. A display for displaying a plurality of frames in sequence, wherein each of the frames has a plurality of pixels and the display has a preset module for recording a sequential flashing threshold value, the display comprising:

a frames-comparing module for comparing the pixels between at least two of the frames obtain corresponding moving values, wherein the corresponding moving values are averaged to generate a motion activity value;

a play-mode determining module for determining whether the two frames are in a relationship of a motion mode or not according to the motion activity value and the sequential flashing threshold value, and generating a sequential flashing controlling signal; and a sequential flashing controlling module for performing a sequential flashing process according to the sequential flashing controlling signal, wherein the motion activity value is greater than the sequential flashing threshold value in the motion mode.

16. The display of claim 15, wherein the play-mode determining module further determines whether the two frames are in a relationship of a motionless mode or not according to the motion activity value and the sequential flashing threshold value, and therefore generates a static flashing controlling signal.

17. The display of claim 16, further comprising:

a static flashing controlling module for performing a static flashing process according to the static flashing controlling signal.

18. The display of claim 16, wherein the motion activity value is less than the sequential flashing threshold value in the motionless mode.

19. The display of claim 15, wherein the two frames are sequentially inputted frames.

20. The display of claim 15, wherein the sequential flashing threshold value is modulated depending on a luminance.

21. The display of claim 20, wherein the luminance is a luminance of the display.

22. The display of claim 21, wherein the luminance of the display is directly proportional to the sequential flashing threshold value.

23. The display of claim 20, wherein the luminance is an environmental luminance.

24. The display of claim 23, wherein the environmental luminance is inversely proportional to the sequential flashing threshold value.

25. The display of claim 15, wherein the sequential flashing process is to light on and turn off light-emitting units of a backlight module of the display in sequence.

26. The display of claim 15, wherein the sequential flashing threshold value is automatically adjusted by the display or manually adjusted by a user.

* * * * *